United States Patent [19]

Smolik

[11] Patent Number: 4,805,364

[45] Date of Patent: Feb. 21, 1989

[54] WALL CONSTRUCTION

[76] Inventor: Robert A. Smolik, 670 W. 7th St., St. Paul, Minn.

[21] Appl. No.: 191,792

[22] Filed: Apr. 29, 1988

Related U.S. Application Data

[63] Continuation of Ser. No. 10,269, Feb. 2, 1987, abandoned.

[51] Int. Cl.[4] ..... E04H 1/00

[52] U.S. Cl. ..... 52/241; 52/483; 52/741

[58] Field of Search ..... 52/241, 290, 634, 636, 52/730, 732, 483, 105, 712, 715, 242, 275, 282, 285, 741

[56] References Cited

U.S. PATENT DOCUMENTS

| | | | |
|---|---|---|---|
| 1,981,239 | 11/1934 | Manske | 174/48 |
| 2,088,781 | 8/1937 | Folsom | 52/634 |
| 2,105,771 | 1/1938 | Holdsworth | 52/290 |
| 2,250,401 | 7/1941 | Sylvester | 52/242 |
| 2,275,109 | 3/1942 | McGee | 52/735 |
| 2,766,855 | 10/1956 | Johnson et al. | 52/242 X |
| 3,101,817 | 8/1963 | Radek | 52/241 |
| 3,270,472 | 9/1966 | Gilbert | 52/483 X |
| 3,332,188 | 7/1967 | Schaefer | 52/349 |
| 3,388,521 | 6/1968 | Tillisch et al. | 52/573 |
| 3,423,896 | 1/1969 | Widerby | 52/395 |
| 3,492,766 | 2/1970 | Andrews | 52/36 |
| 3,536,345 | 10/1970 | Leifer | 52/732 |
| 3,680,271 | 8/1972 | Satchell | 52/656 |
| 3,965,634 | 6/1976 | Murphy | 52/403 |
| 3,993,819 | 11/1976 | Fewkes | 428/136 |
| 4,010,573 | 3/1977 | Andrzejewski | 49/479 |
| 4,194,336 | 3/1980 | Weiner | 52/481 |

FOREIGN PATENT DOCUMENTS

| | | | |
|---|---|---|---|
| 587074 | 11/1947 | United Kingdom . | |
| 2169937A | 7/1956 | United Kingdom | 52/241 |

OTHER PUBLICATIONS

United States Gypsum, 1983, Steel Framing Components Catalog, cover page and page 6.

*Primary Examiner*—John E. Murtagh
*Assistant Examiner*—Andrew Joseph Rudy
*Attorney, Agent, or Firm*—Burd, Bartz & Gutenkauf

[57] ABSTRACT

A wall construction and a method of constructing it comprising a plurality of generally upright wall studs in assembled perpendicular relationship to lower and upper generally horizontal support beams. The wall studs can be of the metal variety having a generally C-shaped profile. The support beams are channel shaped and have spaced apart retaining members extending inwardly from side walls into the channel. Opposing pairs of retaining members form pockets or seats having a profile corresponding at least partially to the cross sectional profile of the wall stud to confine an end of the wall stud. At least one of the support beams has side walls having serrated edges. The retaining members are formed by bending selected serrations inward of the channel or toward the opposite side wall to a horizontal orientation. An installation tool according to the invention is usable to bend the serrations and install wall stud with respect to the serrated support beam.

16 Claims, 2 Drawing Sheets

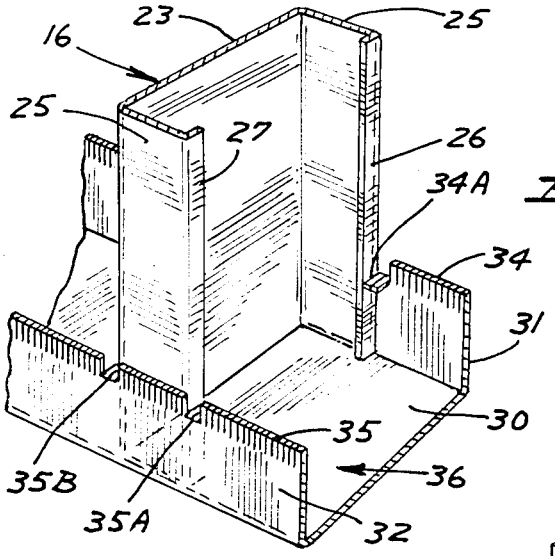
FIG. 5
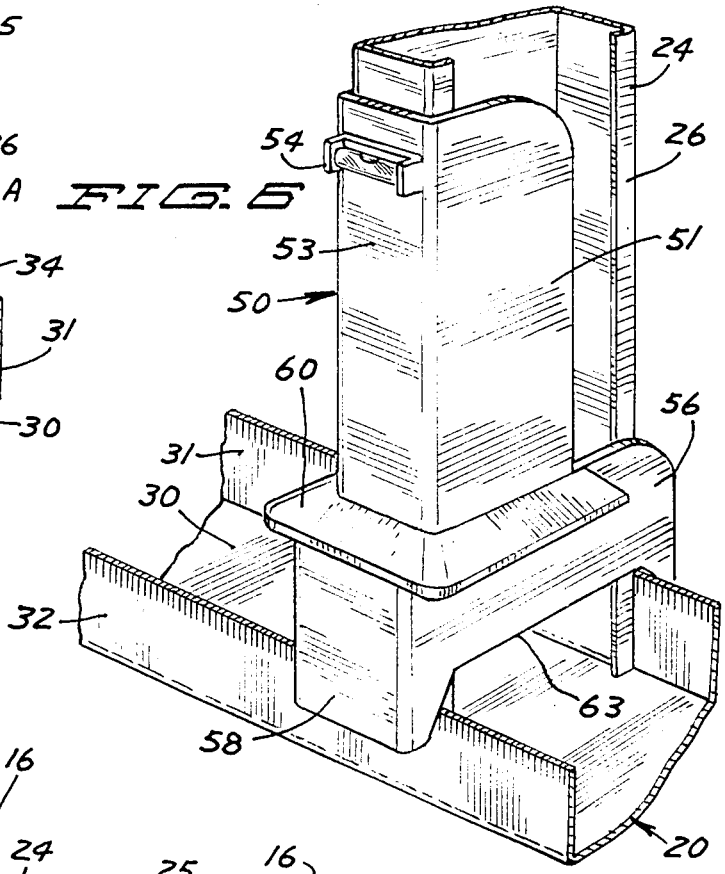
FIG. 6
FIG. 7
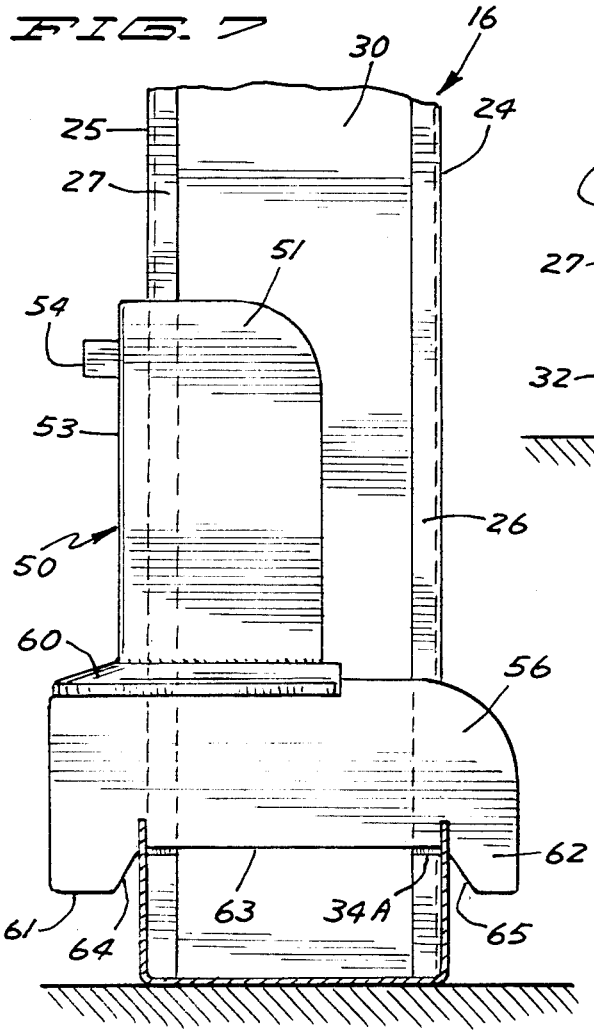
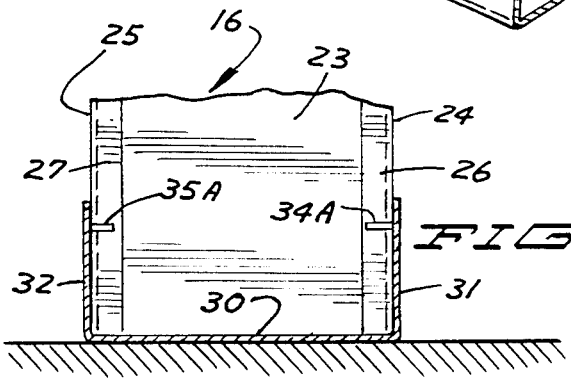
FIG. 8
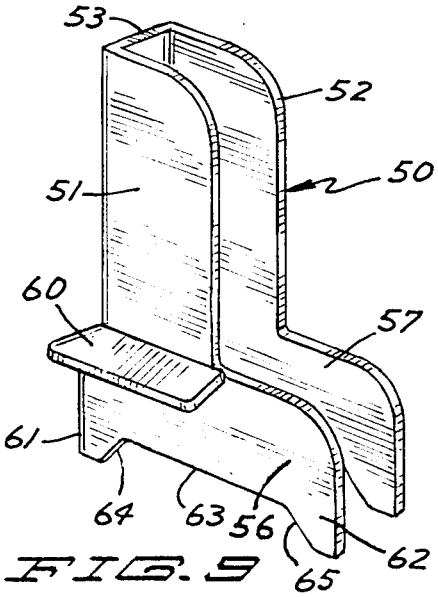
FIG. 9

WALL CONSTRUCTION

This is a continuation of co-pending application Ser. No. 010,269 filed on Feb. 2, 1987 abandoned.

BACKGROUND OF THE INVENTION

In the construction of commercial and residential buildings, labor cost is a significant factor and, accordingly, the speed with which the construction worker proceeds is important. While building materials and tools that increase the efficient use of time the construction worker are desirable, the structural integrity of the finished construction must not be compromised.

Interior wall construction with the use of vertical metal wall studs and horizontal channel shaped runners or track is common. The runners and studs are assembled into a frame structure that is secured to floors and ceilings. The frame structure is covered with dry wall construction panels on one or both sides to form a wall surface. Assembly of the frame structure can be tedious and time consuming. According to one method, narrow slots are formed at the upper and lower ends of the metal wall stud near the corners. The side walls of the channel shaped runners are fitted in the slots and metal screws are used to fix adjacent portions of the runner side walls and metal wall studs. The resultant wall assembly is satisfactorily structurally but, nonetheless, slow in construction. The upper and lower ends of the wall studs are fixably secured to the runners which can be problematic upon thermal expansion and contraction of the building walls.

SUMMARY OF THE INVENTION

The invention pertains to wall construction wherein vertical metal wall studs are assembled to horizontal channel shaped runners or track to form a framework for mounting drywall construction panels or other wall material in formation of a wall. Lower and upper channel shaped support beams are fastened in parallel relationship, respectively, to the floor and ceiling of a building at the intended wall site. Each support beam has a flat base for attachment to the ceiling or floor structure and parallel side walls perpendicular to the base forming a channel. On at least one of the support beams, preferably the lower one, the outer edges of the side walls, or the edges opposite the base, are serrated or provided with a row of spaced apart teeth continuous at least in the vicinity of the intended installation of a wall stud. Teeth on each side wall are readily deformable so as to be bendable toward the other side wall to form a retaining member in the channel. A plurality of retaining members thus formed in the channel define a pocket for retention of the end of a vertical wall stud. The pocket is formed by bending the teeth around the perimeter of the wall stud when the wall stud is situated in place in the channel. Usually at least two adjacent teeth will be bent over into the channel to form a retaining member.

In terms of a method of wall construction, there is provided a channel shaped support beam having side walls with upper edges provided with continuous serrations or teeth. An upright generally C-shaped wall stud is placed in the channel between the side walls. The teeth adjacent the perimeter of the metal wall stud are bent into the channel of the beam to form retaining members defining a pocket. The same method can be practiced at the other end of the wall stud. A particular tool is provided for facilitation of bending or inward deformation of the teeth to form the retaining pocket about the wall stud positioned in the channel.

IN THE DRAWINGS

FIG. 5 is a perspective view showing one end of a vertical wall stud installed in a construction track in accordance with to the present invention;

FIG. 6 is a perspective view showing one end of a vertical wall stud positioned in a support beam preparatory to installation with the use of an installation tool according to the invention;

FIG. 7 is a side plan view of the tool, vertical wall stud and support beam of FIG. 6 shown with the tool having deformed the teeth of the support beam to form retaining members;

FIG. 8 is an end view in section of the wall stud installed in the support beam of FIG. 5; and FIG. 9 is a perspective view of the installation tool according to the invention.

DESCRIPTION OF A PREFERRED EMBODIMENT

Figure 1:
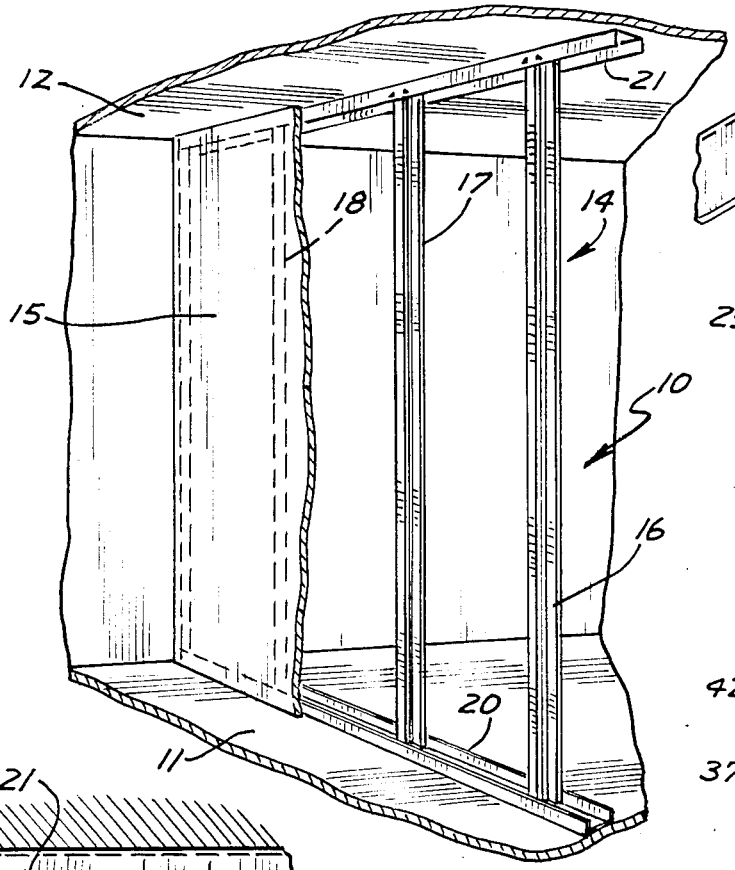
FIG. 1 is a fragmentary perspective view of wall construction according to the present invention with portions removed for purposes of illustration.
Figure 2:
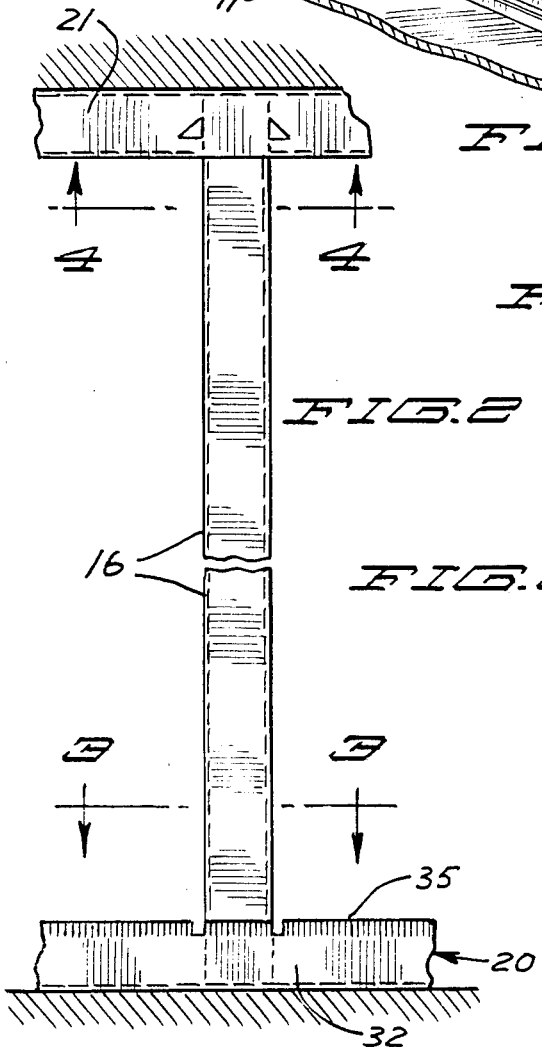
FIG. 2 is a side elevational view of one of the vertical wall studs of the wall construction of FIG. 1, shown foreshortened for purposes of illustration and installed between upper and lower support beams.

Referring to the drawings, there is shown in FIG. 1 a wall construction section according to the invention indicated generally at 10 installed with respect to a lower support surface or floor 11, and an upper support surface or ceiling 12. Wall section 10 is installed on a story of a building, spanning the distance between the floor and ceiling which, in typical modern commercial construction, will be comprised of concrete or similar fireproof material. Wall construction 10 includes a wall frame work 14 to be covered on one or both sides by dry wall paneling or other wall board, partially shown at 15. Wall section 10 is quickly and easily erected for efficient use of the construction workers time without compromising the structural integrity of the resultant wall structure.

Figure 3:
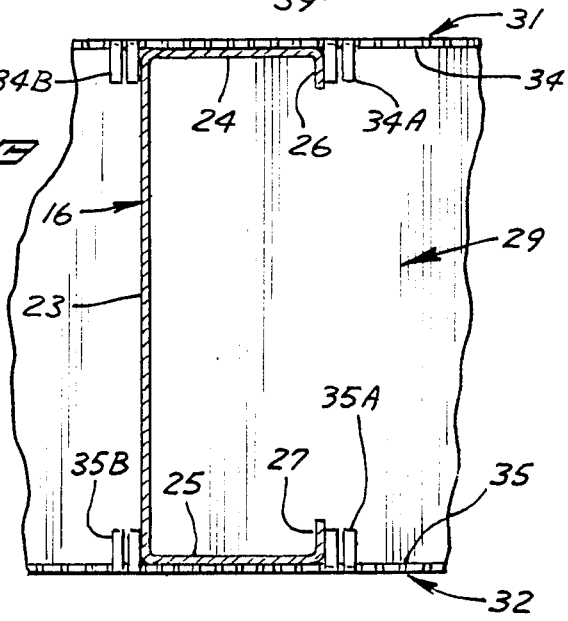
FIG. 3 is an enlarged sectional view of a portion of the wall stud and support beam of FIG. 2 taken along the line 3—3 thereof.

Wall framework 10 is shown to include a plurality of upright or generally vertical metal wall studs 16, 17, 18 having lower and upper ends in assembled relationship, respectively, to a lower channel shaped support beam or track 20 and an upper channel shaped support beam or track 21. Each wall stud has a longitudinal axis corresponding to its height. The wall studs are of the C-shaped variety being generally rectangular in cross sectional profile. As shown in FIG. 3, a typical wall stud 16 is thin-walled and includes a major side member 23 and first and second end members 24, 25 disposed in perpendicular relationship to the major side member 23. Wall stud 16 has a cross sectional length defined by the outside distance between end members 24, 25. First and second lips 26, 27 extend inwardly from opposite edges of the end members 24, 25 toward the center of the channel of support beam 20, terminating a short distance inwardly and defining an opening 29. A cross-sectional width is defined by the outside distance between major side member 23 and lips 26, 27. Stud 16 is typically formed of steel providing a strong compression member that is flexible and deflectable about its longitudinal axis by virtue of opening 29.

The upper end of wall stud 14 is confined by upper support beam 21, and the lower end by lower support beam 20. The lower support beam 20 has a horizontally disposed base wall 30 fixed to floor 11 by any usual and preferred means such as screws (not shown). First and second parallel side walls 31, 32 extend vertically from and in perpendicular relationship to the base wall 30. Each of the side walls has a serrated outer edge or margin formed by continuous serrations or alternating notches and discrete serrations or teeth. The serrations or teeth are continuous at least in the vicinity of intended installation of the wall stud. As shown in FIG. 5, the side wall 31 has discrete teeth 34 which form the outer edge or margin of side wall 31 and are positioned in side-by-side relationship separated by spaces or notches. The second side wall 32 has discrete serrations or teeth 35, which extend continuously along the edge of the side wall 32, are relatively narrow and rectangular in shape and separated by notches. The teeth 34, 35 are formed by suitable, conventional means such as die punching. The length of the teeth is relatively short as compared to the entire length of the side wall, and will vary according to the job to be performed. As typical dimensions, the track or support beam will have a width between 3.5 and 4 inches (8.9 to 10.2 cm) with a wall height between 1.25 and 1.5 inches (3.2 to 3.8 cm). The teeth can be approximately 0.25 inches long (0.6 cm). The teeth can be 1/16 inch wide and spaced apart 1/16 inch resulting in a density of approximately eight teeth per linear inch.

As shown in FIGS. 3 and 5, sets of teeth 34 on the first side wall 31, shown as first and second teeth sets 34A, 34B, are bent or turned inwardly or horizontally in straddling relationship to the end wall 24 of the wall stud 16. Wall stud 16 is positioned with its cross sectional length spanning the width of support beam 20. First and second sets of teeth 35A, 35B are inwardly bent about the perimeter of wall stud 16 or in straddling relationship to the second end member 25 outside of the second lip 27 and the back wall 23. The sets of teeth form retaining members which confine the lower end of the wall stud 23. The teeth are long enough so as to be turned inwardly and extend a distance into the channel sufficient to inhibit twisting or turning of the wall stud when situated in the channel 36 of support beam 20. As shown, each set is composed of two teeth. As formed in the sides 31, 32 of the support beam 20, the teeth 34, 35 are readily deformable so as to be easily turned to a horizontally or inwardly directed orientation to form a retaining pocket. The retaining members can be formed with the wall stud in position. A close but not necessarily tight fit is obtained about the perimeter of the end of the wall stud, such that it is held relatively secure in place. Some amount of leeway for slight movement of the end of the stud is permissible and even desirable to permit slight adjustment of the stud by the workman installing wall board closed to the wall board edge. The number of teeth forming each retaining member may be varied according to the job to be performed. Once the wall stud is in place, the retaining members can be formed by bending the teeth around the lower perimeter of the wall stud using one of a variety of suitable tools, such as a hammer, punch or the like. Alternatively, a tool according to the invention as to be described can be employed. In the infrequent event that the wall stud is to be removed, the teeth are simply bent in reverse so as to be in alignment with the remaining teeth of the serrated edge of the side walls.

Figure 4A:
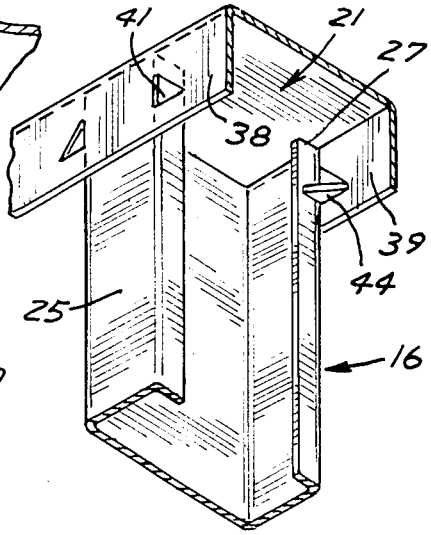
FIG. 4A is a view in perspective of the portion of wall construction shown in FIG. 4.
Figure 4:
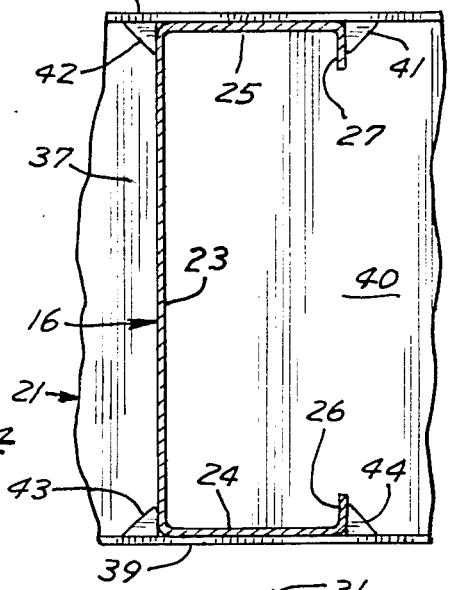
FIG. 4 is an enlarged sectional view of a portion of a wall stud and support beam of FIG. 2 taken along the line 4—4 thereof.

The opposite or upper end of wall stud 16 is retained with respect to the upper support beam 21 by a plurality of retaining members extending into the channel of the support beam 21 to form a pocket conforming to the profile of the wall stud. The upper support beam could be formed in like fashion to the lower support beam 20, having serrated margins with inwardly bendable teeth to form a retaining pocket. Alternatively, support beam 21 can have a configuration like that shown in FIG. 4. Support beam 21 has a base 37 and perpendicularly orientated side walls 38, 39 which form a channel 40. A mounting pocket or seat is formed for retention of the upper end portion of the wall stud 16 by a plurality or a set of inwardly projecting retaining members or fingers 41–44. A first pair of retaining fingers 41, 42 extend inwardly of channel 40 from the side wall 38 of support beam 21 and are spaced apart on the side wall a distance corresponding to the cross sectional width of the wall stud 16. A second pair of fingers 43, 44 extend inwardly in symmetrical relationship from the second side wall 39 in facing relationship to the first pair of retaining fingers. The retaining fingers 41–44 are located intermediate or approximately midway between the top and bottom edges of the side walls 38, 39 of support beam 21. The retaining fingers define a rectangular pattern corresponding to the undeflected cross sectional shape of the wall stud 16. In the configuration shown, the retaining fingers are right triangularly shaped with legs facing inward of the retaining pocket and with hypotenuses facing outward. The retaining fingers are conveniently formed by punched out portions of the side walls of support beam 21. The planar surfaces of the retaining fingers are parallel to the base 37 of support beam 21. The fingers extend inward of the channel 40 a distance sufficient to hold the top portion of the wall stud 16 in place, yet leave a restriction of sufficient dimension or breadth to permit passage of the wall stud under cross sectional deflection upon assembly of the wall stud to the support beam. A plurality of sets of retaining fingers can be spaced along the length of the support beam 21 for selective installation of vertical wall studs.

The wall stud 16 is positioned with respect to the pocket formed by the fingers 41–44 by inserting the end diagonally with respect to the pocket and then twisting the wall until it snaps into place, with both the cross sectional profile of the wall stud deflecting and upon slight deflection of the walls of the support beam. Alternatively, the end is simply inserted into the pocket in correct profile while the lower end of the wall stud is slid along in the channel of the lower support beam 20 to proper position.

A tool particularly adapted for installation of wall stud with respect to the serrated margin support beams is shown in FIGS. 6 through 9. In FIG. 6 the tool is shown preparatory to installation of a metal wall stud 16 with respect to a support beam 20. In FIG. 7 the tool is shown upon completion of the installation, the finished installation being shown in FIG. 8 and the tool being shown in perspective in FIG. 9. The tool, indicated generally at 50, is of a size and shape to fit a standard vertical metal stud for installation with respect to a standard size support beam and is operable to form the first through fourth retaining fingers in straddling relationship to the profile or perimeter of the wall stud simultaneously, and with minimum time and effort so the worker can go on to the next wall stud. The tool 50 includes a base or handle section comprised of first and second side members 51, 52 connected by a back member 53 forming a channel of a width to closely engage the vertical wall stud 16 from one end thereof and be slidable up and down along it. A bubble balance 54 is fixed to the back member 53 of the base so that the worker can sight a straight up and down orientation of the stud preparatory to installation of it with respect to the support beam 20.

An impact or hammer section is connected to the handle and guide section and includes first and second jaw members 56, 57 which are vertically alligned with the first and second side members 51, 52 when the tool 50 is in upright and working orientation. The jaw members 56, 57 straddle the sides of the vertical wall stud 16 and span the channel of the support beam 20. The jaw members 56, 57 are connected to the side members 51, 52 of the base and are joined rearwardly by a back wall 58. A outwardly extended flange or collar 60 extends outward and slightly downward at the intersection of the impact section and the handle section of the tool 50. Collar 60 is coextensive with the side members and back member of the base.

Each jaw member has first and second feet 61, 62, which are connected by a downwardly facing horizontal shoulder 63. The first foot 61 has an inclined ramp or neck 64 that intersects the shoulder 63. The second foot 62 has an inclined ramp or neck 65 that also intersects the shoulder 63. The ramps 64, 65 extend outwardly and downwardly with respect to the shoulder 63. The shoulder 63 is of a length sufficient to almost span the distance between the side walls 31, 32 of the support beam 20. The length of the shoulder 63 is less than the outside dimension between the outside surfaces of the side walls, and is approximate equal to the inside width of the channel 36 or the distance between inside surfaces of the sidewalls 31, 32. Upon placement of tool 50 in spanning relation to the channel of beam 20, the ramps 64, 65 are aligned with the outer edges 34, 45 of side walls 31, 32.

Preparatory to use, the tool 50 is poised as shown in FIG. 6 with the the side members 51, 52 and the jaw members 56, 57 closely straddling the vertical wall stud 16 from one side thereof. The tool 50 is hand held and spaced from the support beam by the construction worker grasping the side members 51, 52 adjacent collar 60. Shoulder 63 of jaw member 56 spans the distance between the side walls 31, 32. A portion of the ramp 64 of the first foot 61 is poised over the edge of the second side wall 32. The intersection of the ramp 64 and the shoulder 63 is in approximate vertical alignment with the inside surface of the side wall 32. The ramp 65 of the second foot 64 is likewise poised over the edge of the opposite side wall 31. The opposite jaw 57 is similarly situated on the opposite side of the vertical wall stud 16. With the tool 50 so poised, the worker abrubtly moves or slams the tool downward guided by the wall stud 16. The ramps 64, 65 engage serrations of the edge of the side walls 31, 32. Due to the inclination of the ramps, the serrations or teeth are pushed inwardly to a point of engagement with the shoulder 63. Upon further downward movement the teeth are moved to the horizontal position shown in FIGS. 7 and 8, forming retaining members extending into the channel of the support beam. The retaining members thus formed are disposed immediately adjacent portions of the vertical wall stud 16. The width of the shoulder 63 and the legs 64, 65 can be such as to engage two serrations at a time and form retaining members of a two-serration width. The width of the members could be more or less as needed for a particular job. In the process of moving the tool 50 downward, the hand of the worker can bear against the collar 60.

Once having formed the serrations in position to confine the vertical wall stud 16, the tool 50 is readily removed. The entire process of installing the wall stud can be accomplished in only a few seconds.

In terms of the method, a support beam 20 provided with side walls 31, 32 having serrated edges 34, 35 is positioned with respect to a supporting surface. A vertical wall stud is placed in the channel of the support beam with portions adjacent the serrated edges. The serrations of the edges adjacent the wall stud portions are bent inwardly toward the channel at a plurality of locations to form a retaining pocket which confines the end of the wall stud.

While there has been shown and described certain embodiments of the invention, it will be apparent that changes and deviations can be had without departing from the scope and spirit of the invention.

The embodiments of the invention in which an exclusive property or privilege is claimed are defined as follows:

1. A wall construction comprising:

a framework formed of a plurality of longitudinal wall studs having generally rectangular cross sectional profiles;

a first support beam having a longitudinal axis and formed of resiliently deflectable material, said beam having a base wall, first and second side walls extended perpendicularly from the base wall forming a channel having a width corresponding to the cross sectional length of a wall stud;

said first side wall having a first row of serrations for a substantial portion of the length thereof, said second side wall having a second row of serrations for a substantial portion of the length thereof, said serrations comprised as relatively narrow teeth spaced apart a distance of approximately the width of a tooth;

a plurality of pockets formed in the support beam for retention of ends of vertical wall studs;

said wall studs disposed in perpendicular relationship to the support beam with first ends retained in pockets of the support beam with end walls situated adjacent side walls of the support beam, said wall stud end walls being of a dimension to be in spanning relationship to at least several serrations on the support beam side walls;

said pockets formed at any selected position along the beam by first and second sets of serrations on the first side wall being bent inwardly of the channel to a generally horizontal position forming first and second retaining fingers, third and fourth sets of serrations on the second side wall being bent inwardly of the channel forming third and fourth retaining members, said first, second, third and fourth retaining members defining said pocket corresponding to the shape of the end of a vertical wall stud for retention of the end of the vertical wall stud.

2. The wall construction of claim 1 including: a second support beam disposed in parallel facing relationship to the first support beam and having a base wall, first and second perpendicular side walls forming a channel, said second support beam having a plurality of pockets formed by first and second retaining members extended from the first side wall into the channel, second and third retaining members extended from the second side wall into the channel, said first, second, third and fourth retaining members forming second pockets corresponding in shape to the cross sectional profile of a vertical wall stud, said vertical wall studs having second ends retained in the pockets of the second support beam.

3. The wall assembly of claim 2 wherein: said first, second, third and fourth retaining members of the pockets on the second support beam are comprised as punched out portions of the side walls extending into the channel.

4. The wall construction in claim 2 wherein: said second support beam of first side wall has a first row of serrations, and the second side wall has a second row of serrations, said retaining members of each pocket on the second support beam being formed by first, second, third and fourth sets of serrations being turned inwardly toward the channel.

5. The wall construction in claim 1 wherein: the serraions of the first, second, third and fourth sets of serrations are bent inwardly to a position generally parallel to the base of the first support beam.

6. The wall construction of claim 1 wherein: said serrations are generally rectangular in shape.

7. The wall construction of claim 1 wherein: said serraions are approximately 0.06 inches wide and are spaced apart approximately 0.06 inches.

8. The wall construction of claim 6 wherein: said serrations are continuous along the length of the support beam.

9. A wall construction track for receipt of an end of a wall stud comprising:

an elongate longitudinal channel shaped member formed of bendable material having a base and first and second side walls extended in perpendicular relationship from the base, said first side wall having an outer edge with a first continuous row of serrations formed substantially along the length of the member, said serrations extending in a direction from the outer edge toward the base to form an outer margin of the first side wall, said second side wall having an outer edge with a second continuous row of serrations formed substantially along the length of the member, said serrations extending in a direction from the outer edge toward the base to form an outer margin of the second side wall, said serrations comprised as relatively narrow teeth spaced apart a distance of approximately the width of a tooth, said serrations being initially parallel and selectively bendable inward of the channel to a position generally parallel to the base in the formation of a pocket at a chosen position along the channel of a shape to receive the end of a wall stud.

10. The wall construction track of claim 9 wherein: said serrations are generally rectangular.

11. The wall construction track of claim 10 wherein: each side wall has a height of between 1.25 and 1.5 inches and the base has a width between 3.5 and 4.0 inches.

12. The wall construction track of claim 11 wherein: said teeth are approximately 0.06 inch wide are spaced apart on the outer edges of the first and second side walls a distance of approximately 0.06 inch.

13. The wall construction track of claim 12 wherein: the serrations on the first and second side walls have a length of approximately 0.25 inches.

14. A method of wall construction comprising:

providing a plurality of longitudinal wall studs;

providing a channel shaped support beam having a base and first and second side walls extending perpendicularly from the base, said first side wall having a first serrated outer edge substantially continuous along the length thereof, said second side wall having a second serrated outer edge substantially continuous along the length thereof, each serrated edge being comprised of a plurality of discrete relatively narrow teeth spaced apart a distance of approximately the width of a tooth;

assembling a wall stud to the support beam by placing one end of the wall stud in the channel of the support beam at any preselected location, said wall stud having sides in adjacent relationship to the side walls of the support beam and of a dimension to span at least several of said serrations;

confining the end of the wall stud in a support beam by bending serrations of the first side wall on either side of the wall stud and bending serrations of the second side wall about either side of the wall stud to form a retaining pocket confining the end of the wall stud.

15. The method of claim 14 including: assembling second ends of the wall studs to a second support beam.

16. The method of claim 14 wherein said second support beam is provided with first and second side walls and a base wall perpendicular to the side walls, said first and second side walls having first and second serrated edges, and including: assembling the second ends of the vertical wall studs to the second support beam by inserting the second ends in the support beam channel and bending over serrations from the first and second edges about the second end of the wall stud to conform a retaining pocket to confine the second end of the wall stud.

* * * * *